United States Patent [19]

Shellenberger et al.

[11] Patent Number: 4,926,840

[45] Date of Patent: May 22, 1990

[54] PILOT GAS BYPASS SYSTEM FOR FUEL-FIRED FURNACES

[75] Inventors: Timothy J. Shellenberger; William T. Harrigill, both of Fort Smith, Ark.

[73] Assignee: Rheem Manufacturing Company

[21] Appl. No.: 415,122

[22] Filed: Sep. 28, 1989

[51] Int. Cl.[5] ..... F24H 3/00

[52] U.S. Cl. ..... 126/110 R; 126/116 R

[58] Field of Search ..... 126/110 R, 99 A, 116 R

[56] References Cited

U.S. PATENT DOCUMENTS

| | | | |
|---|---|---|---|
| 2,499,358 | 3/1950 | Cooper et al. | 257/2 |
| 2,521,866 | 9/1950 | Ott | 126/110 |
| 2,769,619 | 11/1956 | Juhasz | 257/6 |
| 3,194,214 | 7/1965 | Frendberg | 122/1 |
| 3,667,451 | 6/1972 | Boucher | 126/110 |
| 4,533,315 | 8/1985 | Nelson | 431/20 |
| 4,576,226 | 3/1986 | Lipets | 165/134.1 |
| 4,603,681 | 8/1986 | Clawson | 126/110 |
| 4,807,588 | 2/1989 | Beatley | 126/110 |

*Primary Examiner*—Carroll B. Dority

*Attorney, Agent, or Firm*—Hubbard, Thurman, Turner, Tucker & Harris

[57] ABSTRACT

To inhibit internal heat exchanger corrosion, the products of combustion from a standing pilot flame in an induced draft, fuel-fired furnace are prevented from migrating through the heat exchanger during idle periods of the furnace by flowing the products of combustion upwardly through a small vent tube into the outlet section of the draft inducer fan, and then into an external exhaust stack, thereby bypassing the heat exchanger. During operation of the draft inducer fan a negative pressure is maintained within the vent tube, to prevent combustion gas outflow therethrough which might otherwise snuff out the pilot flame, by a venturi structure positioned within the draft inducer fan outlet section adjacent its juncture with the vent tube.

12 Claims, 2 Drawing Sheets

PILOT GAS BYPASS SYSTEM FOR FUEL-FIRED FURNACES

BACKGROUND OF THE INVENTION

The present invention relates generally to furnace apparatus and, in a preferred embodiment thereof, more particularly provides an induced draft, fuel-fired furnace having incorporated therein a bypass system for substantially preventing the combustion products from a standing pilot flame within the furnace from internally migrating through the furnace heat exchanger, and potentially corroding it, during idle periods of the furnace.

The National Appliance Energy Conservation Act of 1987 mandates that all forced air furnaces produced after Jan. 1, 1992, and having heat output ratings of from 45,000 to 400,000 Btuh, must have a minimum heating efficiency of 78% based upon Department of Energy test procedures. The increased stringency of this new requirement imposed upon furnace manufacturers has prompted a considerable amount of redesign effort, since most forced air furnaces of this type currently being manufactured do not meet the upcoming heating efficiency standards.

One furnace modification currently being investigated in an attempt to meet these higher heating efficiency standards is the provision of an improved efficiency furnace heat exchanger through which the main burner system combustion products are flowed to transfer heat to supply air forced externally across the heat exchanger. The typical heat exchanger presently utilized in forced air furnaces of this type is of a relatively large "clamshell" configuration which has a relatively low resistance to combustion product flow therethrough.

In conjunction with this conventional clamshell type heat exchanger, a standing pilot flame is continuously maintained within the furnace housing to ignite fuel discharged from the main burner structure when the furnace experiences a demand for heat from its associated space thermostat. As is well known, the structure used to create and maintain such standing pilot flame is quite simple and reliable, is relatively inexpensive, and is easy to install and replace. In the conventional atmospheric furnace, the continuously generated combustion products from the standing pilot flame are permitted to vent through the clamshell heat exchanger into an atmospheric exhaust stack during idle periods of the furnace. Due to the relatively low flow pressure drop characteristics of the typical clamshell heat exchanger, the pilot flame combustion products relatively quickly traverse its interior without creating an excessive amount of corrosive condensation therein.

A method being currently being considered for improving furnace heat exchanger efficiency is to increase the heat exchanger internal flow pressure drop and connect the "tighter" heat exchanger to a draft inducer fan which is operative to forcibly draw the main burner combustion products through the heat exchanger and discharge them into the typically provided exhaust stack during heating cycles of the furnace. However, as the internal pressure drop of a heat exchanger is increased, the potential for internal heat exchanger corrosion caused by migration therethrough of standing pilot flame combustion products during idle periods of the furnace is correspondingly increased. This is due to the fact that such pilot flame combustion products are maintained for longer periods of time within the "tighter" heat exchanger, during idle periods of the furnace, thereby creating considerably more corrosive condensation within the heat exchanger.

The result of this heretofore unavoidable trade-off between the enchanced thermal efficiency of a higher pressure drop heat exchanger and heightened heat exchanger corrosion has typically required that the simple and relatively inexpensive standing pilot flame structure be eliminated and replaced with a considerably more complex and expensive electric ignition system. This previously necessary use of the costlier and more complex electric ignition system in conjunction with high pressure drop heat exchangers in induced draft furnaces has correspondingly increased their manufacturing and maintenance costs and added to their structural and operational complexity.

From the foregoing it can be seen that it would be quite desirable to provide an induced draft, fuel-fired furnace which is provided with a high efficiency, relatively high pressure drop heat exchanger, while at the same time utilizing a standing pilot flame system without creating the aforementioned heat exchanger corrosion problems during idle periods of the furnace. It is accordingly an object of the present invention to provide such a furnace.

SUMMARY OF THE INVENTION

In carrying out the principles of the present invention, in accordance with a preferred embodiment thereof, a high efficiency, induced draft, fuel-fired furnace is provided which includes a housing, a relatively high pressure drop heat exchanger disposed within the housing, a supply blower for flowing air to be heated externally across the heat exchanger, a main burner system, and a pilot structure for continuously maintaining within the housing a standing pilot flame operative to ignite fuel discharged from the main burner system in response to a demand for heat from the furnace. A draft inducer fan is operatively connected to the heat exchanger to sequentially draw hot combustion products discharged from the main burner system through the heat exchanger and discharge the combustion products exiting the heat exchanger into a suitable external exhaust stack through an outlet section of the draft inducer fan.

To essentially prevent combustion products continuously generated within the housing by the standing pilot flame from internally migrating through the heat exchanger during idle periods of the furnace, a small vent conduit or tube is secured at one end to the outlet section of the draft inducer fan, and is extended downwardly therefrom to adjacent the standing pilot flame. The vent tube creates a vent passage through which the combustion products from the standing pilot flame upwardly flow into the draft inducer fan outlet section, and then into the external exhaust stack, during idle periods of the furnace (during which neither the draft inducer fan nor the main burner system is operating). Accordingly, during such idle periods of the furnace, essentially all of the products of combustion from the standing pilot flame completely bypass the interior of the heat exchanger to thereby prevent such pilot flame combustion products from condensing upon and potentially corroding the interior heat exchanger surface.

During periods of draft inducer fan operation, outflow of combustion products from the pressurized interior of the inducer fan outlet section through the vent tube, which might otherwise snuff out the standing pilot flame, is prevented by a vane member secured within the fan outlet section adjacent its juncture with the upper end of the vent tube. In response to combustion product discharge through the fan outlet section, the vane structure creates a venturi area within the outlet section adjacent the upper end of the vent tube, thereby maintaining a negative pressure within the vent tube.

DETAILED DESCRIPTION

Figure 1:
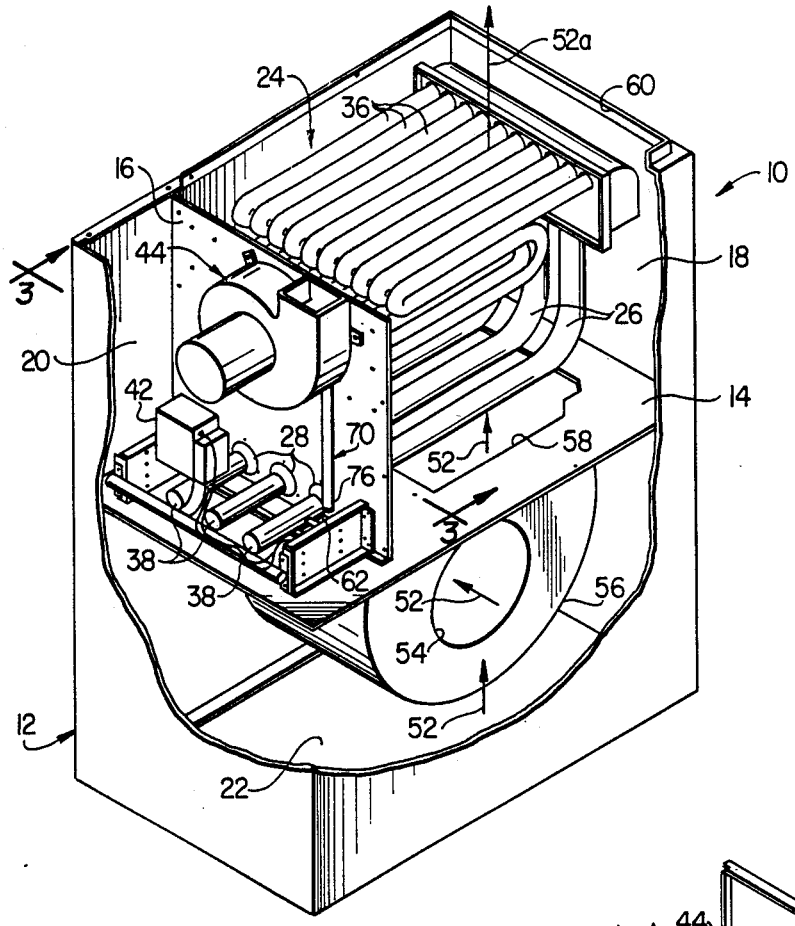
FIGS. 1 and 2 are partially cut away perspective views of an induced draft, fuel-fired furnace embodying principles of the present invention.
Figure 2:
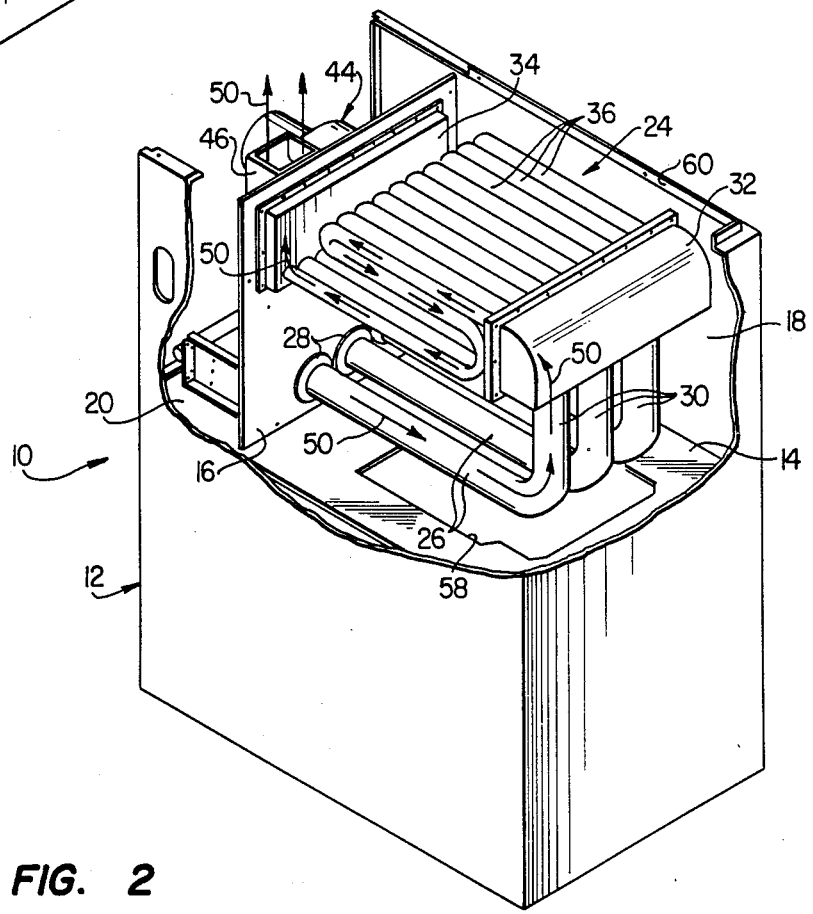

Perspectively illustrated in FIGS. 1 and 2 is a high efficiency, induced draft, fuel-fired furnace 10 which embodies principles of the present invention. The furnace 10 includes a housing 12 which is interiorly divided, by a horizontal wall 14 and a vertical wall 16, into a supply air plenum 18 and a burner and fan chamber 20 which are positioned above an air inlet plenum 22. Operatively positioned within the supply air plenum 18 is a relatively high pressure drop, high efficiency heat exchanger structure 24 which includes three relatively large diameter, generally L-shaped primary tubes 26 which are secured at their open inlet ends 28 to a lower portion of the interior wall 16. The upturned outlet ends 30 of the primary tubes 26 are connected to the bottom side of a transition manifold structure 32 which is spaced rightwardly apart from a combustion gas collection manifold 34 suitably secured to an upper portion of the interior wall 16. The interior of the manifold 32 is communicated with the interior of the manifold 34 by means of a horizontally spaced series of vertically serpentined secondary tubes 36 each connected at its opposite ends to the manifolds 32, 34 and having a considerably smaller diameter than the primary tubes 26.

Three horizontally spaced apart main gas burners 38 are operatively mounted within a lower portion of the chamber 20 and are supplied with gaseous fuel (such as natural gas), through supply piping 40 (FIG. 3), by a gas valve 42. A draft inducer fan 44 positioned within the chamber 20 is mounted on an upper portion of the interior wall 16, above the burners 38, and has an inlet communicating with the interior of the manifold 34, and an outlet section 46 coupled to an external exhaust stack 48 (FIG. 3).

Upon a demand for heat from the furnace 10, by a thermostat (not illustrated) located in the space to be heated, the burners 38 and the draft inducer fan 44 are energized. Flames and products of combustion 50 from the burners 38 are directed into the open inlet ends 28 of the primary heat exchanger tubes 26, and the combustion products 50 are drawn through the heat exchanger structure 24 by operation of the draft inducer fan 44. Specifically, the burner combustion products 50 are drawn by the draft inducer fan, as indicated in FIG. 2, sequentially through the primary tubes 26, into the manifold 32, through the secondary tubes 36 into the manifold 34, from the manifold 34 into the inlet of the fan 44, and through the outlet section 46 of the fan 44 into the exhaust stack 48.

At the same time, return air 52 (FIG. 1) from the heated space is drawn upwardly into the inlet plenum 22 and flowed into the inlet 54 of a supply blower 56 disposed therein. Return air 52 entering the blower inlet 54 is forced upwardly into the supply air plenum 18 through an opening 58 in the interior housing wall 14. The return air 52 is then forced upwardly and externally across the heat exchanger structure 24 to convert the return air 52 into heated supply air 52*a* which is upwardly discharged from the furnace through a top end outlet opening 60 to which a suitable supply ductwork system (not illustrated) is connected to flow the supply air 52*a* into the space to be heated.

Figure 3:
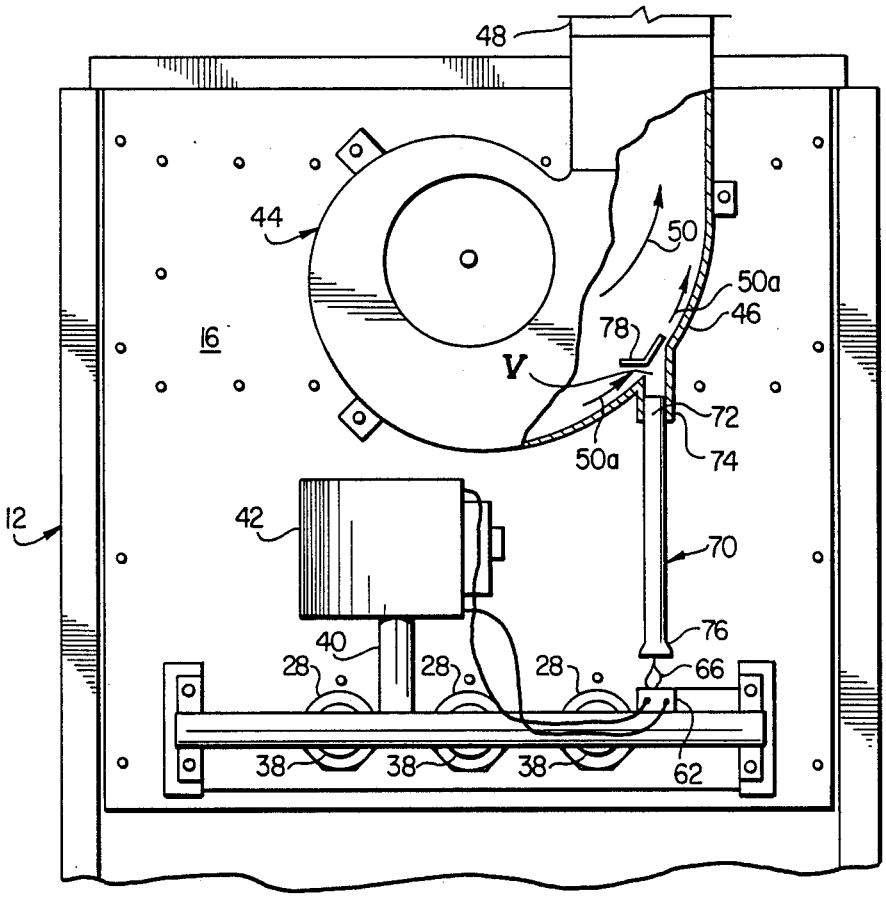
FIG. 3 is an enlarged scale, partially sectioned interior side elevational view of the furnace, taken along line 3—3 of FIG. 1, illustrating a unique pilot gas bypass system incorporated therein.
Figure 4:
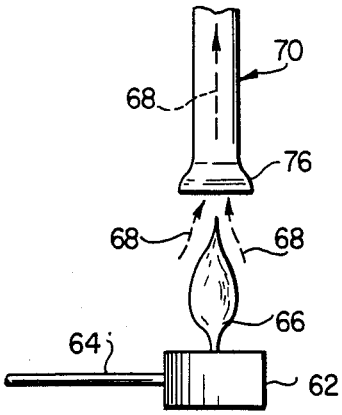
FIG. 4 is a simplified schematic diagram illustrating the operation of a vent tube portion of the pilot gas bypass system.

Referring now to FIGS. 1, 3 and 4, a conventional pilot assembly 62 is suitably mounted within the furnace chamber 20 immediately to the right of the rightmost burner 38 adjacent its discharge end. The pilot assembly 62 is supplied with gaseous fuel through a small supply conduit 64, and is operative to continuously maintain within the chamber 20 a standing pilot flame 66 which functions to ignite gaseous fuel discharged from the burners 38 when the gas valve 42 is opened in response to a thermostat demand for heat from the furnace 10. The pilot flame 66 is maintained during both operative periods of the furnace (during which both the burners 38 and the draft inducer fan 44 are energized) and idle periods of the furnace (during which the burners 38 and the draft inducer fan 44 are de-energized). Accordingly, the standing pilot flames 66 continuously generates products of combustion 68 within the furnace chamber 20.

In furnaces of conventional design, these pilot flame combustion products, during idle periods of the furnace, tend to internally migrate through the heat exchanger into the exhaust stack. The temperature differential between these hot combustion products and the much cooler interior heat exchanger surface tends to create corrosive condensation within the heat exchanger, thereby appreciably shortening its operational life.

In the present invention, however, this potential for internal heat exchanger corrosion during idle periods of the furnace is essentially eliminated by the unique provision of a small diameter, vertically oriented pilot flame vent tube 70 disposed within the furnace chamber 20 (see FIGS. 1, 3 and 4). As best illustrated in FIG. 3, the open upper end 72 of the vent tube 70 is received within a downwardly projecting collar fitting 74 secured to a bottom side of the draft inducer fan outlet section 46. The open lower end 76 of the vent tube 70 is positioned immediately above the standing pilot flame 66 (see FIG. 4).

During idle periods of the furnace 10, the combustion products 68 generated by the standing pilot flame 66 do not deleteriously migrate through the interior of the heat exchanger structure 24. Instead, such combustion products 68, by natural draft effect, flow upwardly through the vent tube 70 into the interior of the draft inducer fan outlet section 46 and pass upwardly therefrom into the exhaust stack 48. This is due to the fact that the vent flow passage within the tube 70 has, with respect to the pilot flame combustion products, an effective internal flow resistance less than that of the heat exchanger structure 24, and the pilot flame combustion products 68 take this path of least resistance during idle periods of the furnace.

Accordingly, even though a relatively high pressure drop heat exchanger is utilized in the furnace 10, it is not necessary to use an electric igniter device (with its attendant complexity and expense), which must be operated each time the gas valve 42 is opened, to prevent internal corrosion of the heat exchanger by pilot flame combustion products. Instead, due to the use of the vent tube 70, the much simpler and less expensive pilot assembly 62 may be utilized since the combustion products from its standing pilot flame completely bypass the heat exchanger structure and are essentially prevented from corrosively attacking the interior of the heat exchanger structure during idle periods of the furnace.

It can be seen that the vent tube 70 is connected to a section of the draft inducer fan 44 (i.e., its outlet section 46) which, during operation of the fan 44, is under a positive pressure. To prevent this positive pressure from creating a downflow of burner combustion products 50 through the vent tube 70 (which would tend to snuff out the standing pilot flame 66) a small, metal scoop vane 78 is suitably secured within the draft inducer fan outlet section 46, near its juncture with the collar fitting 74, as best illustrated in FIG. 3. During operation of the fan 44, a major portion of the burner combustion products 50 is forced upwardly through the outlet section 46 into the exhaust stack 48. However, the vane 78 (as best illustrated in FIG. 3) functions to intercept a small portion 50*a* of the combustion product flow 50 and direct it past the inner end of the collar fitting 74 with increased velocity. The increased velocity of the combustion product flow stream 50*a* creates in this area a venturi V. This venturi, in turn, creates a negative pressure adjacent the upper end of the collar 74, thereby maintaining a negative pressure within the interior of the vent tube 70 and accordingly preventing an undesirable downflow therethrough of combustion products 50 during operation of the draft inducer fan 44.

The installation of the vent tube 70 and the venturi vane 78 may be very easily and inexpensively carried out, and does not significantly increase the overall manufacturing cost of the high efficiency furnace 10. Additionally, the vent tube 70 and the venturi vane 78 are essentially maintenance free additions to such furnace.

While the pilot gas bypass system of the present invention has been representatively incorporated in an induced draft, forced air residential furnace, it will be readily appreciated that the principles of the present invention may also be employed in other types of induced draft, fuel-fired heating apparatus such as furnaces of other configurations, boilers and the like to inhibit internal heat exchanger corrosion caused by standing pilot flame combustion products.

The foregoing detailed description is to be clearly understood as being given by way of illustration and example only, the spirit and scope of the present invention being limited solely by the appended claims.

What is claimed is:

1. Induced draft, fuel-fired furnace apparatus comprising:

a housing;

heat exchanger means, disposed within said housing, through which hot combustion products may be internally flowed to transfer heat to air flowed externally across said heat exchanger means;

blower means for flowing air to be heated externally across said heat exchanger means;

burner means selectively operable to receive fuel from a source thereof and discharge the received fuel;

pilot means for continuously maintaining within said housing a standing pilot flame operative to ignite fuel discharged from said burner means to thereby create hot combustion products from the discharged fuel, said pilot flame continuously generating hot combustion products within said housing;

draft inducing fan means connected to said heat exchanger means and connectable to an exhaust stack, said draft inducing fan means being selectively operable to sequentially draw hot combustion products discharged from said burner means through said heat exchanger means and discharge combustion products exiting said heat exchanger means into and through the exhaust stack when connected thereto; and means for venting hot combustion products from said pilot flame into the exhaust stack through said draft inducing fan means, during idle periods thereof, in a manner precluding an appreciable amount of pilot flame combustion products from interiorly traversing said heat exchanger means.

2. The furnace apparatus of claim 1 wherein:

said draft inducing fan means have an outlet section, said means for venting hot combustion products include means for defining a vent inlet flow passage extending from adjacent said pilot flame into the interior of said outlet section of said draft inducing fan means and bypassing the interior of said heat exchanger means, and said furnace apparatus further comprises means for preventing fluid flow through said vent inlet flow passage, from said outlet section of said draft inducing fan means toward said pilot flame, during operation of said draft inducing fan means.

3. The furnace apparatus of claim 2 wherein:

said means for preventing fluid flow includes means, responsive to operation of said draft inducing fan means, for creating a negative pressure within said vent inlet flow passage.

4. Induced draft, fuel-fired furnace apparatus comprising:

a housing;

a heat exchanger disposed within said housing and having an inlet portion and an outlet portion; a burner adapted to receive fuel from a source thereof and discharge the received fuel;

a pilot flame structure adapted to utilize fuel from a source thereof to maintain a standing pilot flame positioned within said housing externally of said heat exchanger, and operative to ignite fuel discharged from said burner;

a draft inducer fan for drawing products of combustion from said burner interiorly through said heat exchanger, said draft inducer fan having an inlet section connected to said outlet portion of said heat exchanger to receive products of combustion therefrom, and an outlet section for discharging the received products of combustion to an external exhaust passage;

a blower for flowing air to be heated externally across said heat exchanger;

a vent tube extending outwardly from said outlet section of said draft inducer fan to adjacent said standing pilot flame and operative to flow combustion products therefrom into said outlet section, and then into the external exhaust passage, during idle periods of said furnace, to thereby substantially prevent migration of said pilot flame combustion products through said heat exchanger during said idle periods; and a vane structure positioned within said outlet section of said draft inducer fan and operative, during operation of said draft inducer fan, to maintain a negative pressure within said vent tube to substantially prevent combustion product outflow therethrough.

5. High efficiency furnace apparatus comprising:

wall means for defining a housing;

heat exchanger means positioned within said housing for receiving an internal throughflow of combustion products and transferring heat therefrom to air flowed externally across said heat exchanger means, said heat exchanger means having a relatively high resistance to combustion product flow therethrough;

blower means for flowing air through said housing, and externally across said heat exchanger means, to heat the air;

burner means selectively operable to receive fuel from a source thereof and discharge the received fuel into said housing;

pilot means for continuously generating and maintaining within said housing a standing pilot flame positioned to ignite fuel discharged from said burner means to thereby create hot combustion products from the discharged fuel;

draft inducing fan means connected to said heat exchanger means and selectively operable to draw burner means combustion products through said heat exchanger means and then discharge the combustion products from said housing to an external exhaust stack or the like; and means for venting combustion products from said standing pilot flame to the exhaust stack in a manner preventing an appreciable portion of the pilot flame combustion products from internally traversing and potentially corroding said heat exchanger means during said idle periods of said furnace apparatus.

6. The high efficiency furnace apparatus of claim 5 wherein:

said means for venting combustion products from said standing pilot flame include wall means for defining a vent flow passage extending from adjacent said standing pilot flame to the interior of said draft inducing fan means.

7. The high efficiency furnace apparatus of claim 6 wherein:

said draft inducing fan means have an outlet section, said vent flow passage extends from adjacent said standing pilot flame to the interior of said outlet section, and said high efficiency furnace apparatus further comprises means for essentially preventing fluid flow from the interior of said outlet section through said vent flow passage toward said pilot means.

8. The high efficiency furnace apparatus of claim 7 wherein:

said means for essentially preventing fluid flow include means for creating and maintaining a negative pressure within said vent flow passage during operation of said draft inducing fan means.

9. The high efficiency furnace apparatus of claim 8 wherein:

said means for creating and maintaining a negative pressure include means, responsive to operation of said draft inducing fan means, for creating a venturi flow area positioned within said outlet section adjacent its juncture with said vent flow passage.

10. Heating apparatus comprising:

a housing;

a heat exchanger disposed within said housing for receiving an internal throughflow of hot combustion products and transferring heat therefrom to a fluid flowed externally across said heat exchanger;

a vent structure connected to said heat exchanger and operative to vent combustion products exiting said heat exchanger;

a burner operative to receive fuel from a source thereof and discharge the received fuel within said housing;

a pilot structure operative to receive fuel from a source thereof and create within said housing a continuously burning standing pilot flame external to said heat exchanger and positioned to ignite fuel discharged from said burner to create therefrom hot combustion products interiorly flowable through said heat exchanger; and a vent conduit disposed externally of said heat exchanger and defining a vent passage, said vent passage extending from adjacent said standing pilot flame to the interior of said vent structure, said vent passage having an effective internal flow resistance less than that of said heat exchanger and being operative, during idle periods of said heating apparatus, to by-pass said heat changer to direct the flow of pilot flame combustion products into said vent structure.

11. A method of substantially preventing combustion products from a standing pilot flame from internally migrating through a heat exchanger within a fuel-fired furnace during idle periods thereof, the furnace having a draft inducer fan connected to the heat exchanger and operative to draw main burner combustion products therethrough, the draft inducer fan having an outlet section for discharging main burner combustion products to a flue during heating periods of the furnace, said method comprising the steps of:

forming a vent flow path disposed externally of the heat exchanger and extending from adjacent the standing pilot flame into the interior of the outlet section of the draft inducer fan; and flowing substantially all of the standing pilot flame combustion products sequentially through said vent flow path, into the interior of the outlet section of the draft inducer fan, and into the flue during idle periods of the furnace.

12. A method of inhibiting internal corrosion in a heat exchanger disposed within the housing of a fuel-fired, forced air furnace having a standing pilot flame disposed within the housing and positioned externally of the heat exchanger, and a draft inducer fan having an inlet operatively connected to the outlet of the heat exchanger, and a fan outlet section, said method comprising the steps of:

forming a vent flow path disposed externally of the heat exchanger and extending from adjacent the standing pilot flame into the interior of the outlet section of the draft inducer fan;

flowing substantially all of the standing pilot flame combustion products into the outlet section of the draft inducer fan, inwardly through said vent flow path, during idle periods of the furnace; and preventing fluid flow from the outlet section of the draft inducer fan outwardly through said vent flow path during operation of the draft inducer fan.

* * * * *

US004926840B1

REEXAMINATION CERTIFICATE (2066th)

United States Patent [19]

[11] B1 4,926,840

Shellenberger et al.

[45] Certificate Issued Jul. 20, 1993

[54] PILOT GAS BYPASS SYSTEM FOR FUEL-FIRED FURNACES

[75] Inventors: Timothy J. Shellenberger; William T. Harrigill, both of Fort Smith, Ark.

[73] Assignee: Rheem Manufacturing Company, New York, N.Y.

Reexamination Request:
No. 90/002,934, Jan. 13, 1993

Reexamination Certificate for:

| | |
|---|---|
| Patent No.: | **4,926,840** |
| Issued: | **May 22, 1990** |
| Appl. No.: | **415,122** |
| Filed: | **Sep. 28, 1989** |

[51] Int. Cl.[5] ..... F24H 3/00
[52] U.S. Cl. ..... 126/110 R; 126/116 R
[58] Field of Search ..... 126/110 R, 116 R, 99 A

[56] References Cited

U.S. PATENT DOCUMENTS

| | | | |
|---|---|---|---|
| 2,499,358 | 3/1950 | Cooper et al. . | |
| 2,521,866 | 9/1950 | Ott | 126/110 |
| 2,769,619 | 11/1956 | Juhasz . | |
| 2,997,132 | 8/1961 | Allander et al. | 183/21 |
| 3,115,818 | 12/1963 | Smith | 98/36 |
| 3,194,214 | 7/1965 | Frendberg | 122/1 |
| 3,667,451 | 6/1972 | Boucher | 126/110 |
| 3,771,320 | 11/1973 | Kenneryd et al. | 62/239 |
| 3,774,587 | 11/1973 | Mutchler | 126/110 R |
| 3,782,303 | 1/1974 | Pfister et al. | 110/162 |
| 4,016,730 | 4/1977 | DeVilliers | 62/476 |
| 4,187,833 | 2/1980 | Zahora et al. | 126/312 |
| 4,306,539 | 12/1981 | Silva | 126/312 |
| 4,454,827 | 6/1984 | Smith et al. | 110/234 |
| 4,533,315 | 8/1985 | Nelson | 431/20 |
| 4,537,178 | 8/1985 | Hwang et al. | 126/110 |
| 4,576,226 | 3/1986 | Lipets | 165/134.1 |
| 4,603,681 | 8/1986 | Clawson | 126/110 |
| 4,632,658 | 12/1986 | Petersen | 431/208 |
| 4,651,714 | 3/1987 | Granberg | 126/378 |
| 4,691,666 | 9/1987 | Scherer | 122/33 |
| 4,752,210 | 6/1988 | Trent | 431/20 |
| 4,768,444 | 9/1988 | DeWerth et al. | 110/160 |
| 4,790,268 | 12/1988 | Eising | 122/17 |
| 4,807,588 | 2/1989 | Beatley | 126/110 |
| 4,846,145 | 7/1989 | Inouci | 126/208 |
| 4,867,673 | 9/1989 | Harrigill | 431/171 |
| 4,938,204 | 7/1990 | Adams | 126/360 R |
| 4,971,023 | 11/1990 | Martinez | 126/21 R |

*Primary Examiner*—Carroll Dority

[57] ABSTRACT

To inhibit internal heat exchanger corrosion, the products of combustion from a standing pilot flame in an induced draft, fuel-fired furnace are prevented from migrating through the heat exchanger during idle periods of the furnace by flowing the products of combustion upwardly through a small vent tube into the outlet section of the draft inducer fan, and then into an external exhaust stack, thereby bypassing the heat exchanger. During operation of the draft inducer fan a negative pressure is maintained within the vent tube, to prevent combustion gas outflow therethrough which might otherwise snuff out the pilot flame, by a venturi structure positioned within the draft inducer fan outlet section adjacent its juncture with the vent tube.

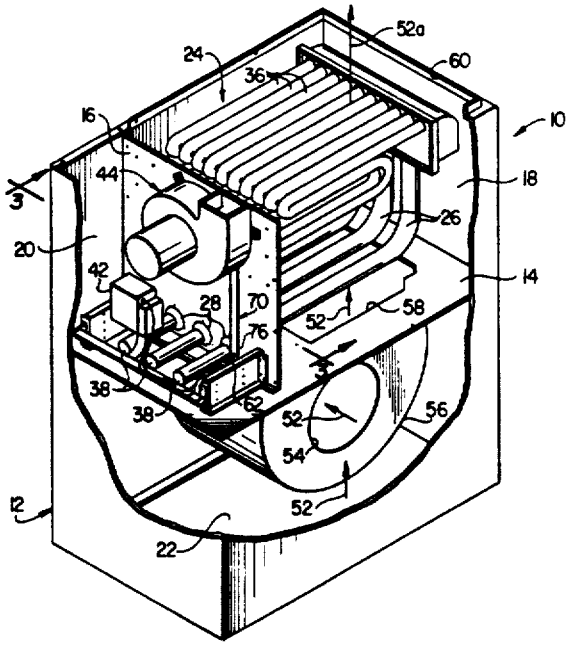

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 12 is confirmed.

Claims 1, 5, 10 and 11 are determined to be patentable as amended.

Claims 2–4 and 6–9, dependent on an amended claim, are determined to be patentable.

1. Induced draft, fuel-fired furnace apparatus comprising:

a housing;

heat exchanger means, disposed within said housing, through which hot combustion products may be internally flowed to transfer heat to air flowed externally across said heat exchanger means;

blower means for flowing air to be heated externally across said heat exchanger means;

burner means selectively operable to receive fuel from a source thereof and discharge the received fuel;

pilot means for continuously maintaining within said housing a standing pilot flame operative to ignite fuel discharged from said burner means to thereby create hot combustion products from the discharged fuel, said pilot flame *being disposed externally of said heat exchanger means and* continuously generating hot combustion products within said housing;

draft inducing fan means connected to said heat exchanger means and connectable to an exhaust stack, said draft inducing fan means being selectively operable to sequentially draw hot combustion products discharged from said burner means through said heat exchanger means and discharge combustion products exiting said heat exchanger means into and through the exhaust stack when connected thereto; and means for venting hot combustion products from said pilot flame into the exhaust stack through said draft inducing fan means, during idle periods thereof, in a manner precluding an appreciable amount of pilot flame combustion products from interiorly traversing said heat exchanger means.

5. High efficiency furnace apparatus comprising:

wall means for defining a housing;

heat exchanger means positioned within said housing for receiving an internal throughflow of combustion products and transferring heat therefrom to air flowed externally across said heat exchanger means, said heat exchanger means having a relatively high resistance to combustion product flow therethrough;

blower means for flowing air through said housing, and externally across said heat exchanger means, to heat the air;

burner means selectively operable to receive fuel from a source thereof and discharge the received fuel into said housing;

pilot means, *disposed externally of said heat exchanger means,* for continuously generating and maintaining within said housing a standing pilot flame positioned to ignite fuel discharged from said burner means to thereby create hot combustion products from the discharged fuel;

draft inducing fan means connected to said heat exchanger means and selectively operable to draw burner means combustion products through said heat exchanger means and then discharge the combustion products from said housing to an external exhaust stack or the like; and means for venting combustion products from said standing pilot flame to the exhaust stack in a manner preventing an appreciable portion of the pilot flame combustion products from internally traversing and potentially corroding said heat exchanger means during said idle periods of said furnace apparatus.

10. Heating apparatus comprising:

a housing;

a heat exchanger disposed within said housing for receiving an internal throughflow of hot combustion products and transferring heat therefrom to a fluid flowed externally across said heat exchanger;

a vent structure connected to said heat exchanger and operative to vent combustion products exiting said heat exchanger;

a burner operative to receive fuel from a source thereof and discharge the received fuel within said housing;

a pilot structure operative to receive fuel from a source thereof and create within said housing a continuously burning standing pilot flame external to said heat exchanger and positioned to ignite fuel discharged from said burner to create therefrom hot combustion products interiorly flowable through said heat exchanger; and a vent conduit disposed externally of said heat exchanger and defining a vent passage, said vent passage extending from adjacent said standing pilot flame to the interior of said vent structure, said vent passage having an effective internal flow resistance less than that of said heat exchanger and being operative, during idle periods of said heating apparatus, to by-pass said heat [changer] *exchanger* to direct the flow of pilot flame combustion products into said vent structure.

11. A method of substantially preventing combustion products from a standing pilot flame from internally migrating through a heat exchanger within a fuel-fired furnace during idle periods thereof, the furnace having a draft inducer fan connected to the heat exchanger and operative to draw main burner combustion products therethrough, the draft inducer fan having an outlet section for discharging main burner combustion products to a flue during heating periods of the furnace, *and the standing pilot flame being disposed externally of the heat exchanger,* said method comprising the steps of:

forming a vent flow path disposed externally of the heat exchanger and extending from adjacent the standing pilot flame into the interior of the outlet section of the draft inducer fan; and flowing substantially all of the standing pilot flame combustion products sequentially through said vent flow path, into the interior of the outlet section of the draft inducer fan, and into the flue during idle periods of the furnace.

* * * * *